US006571993B2

(12) United States Patent
Rodd et al.

(10) Patent No.: US 6,571,993 B2
(45) Date of Patent: Jun. 3, 2003

(54) APPARATUS FOR HOLDING AND METERED DISPENSING OF AN ACTIVE COMPOSITION INTO A WASHING MACHINE, A LAUNDRY DRYER OR A DISHWASHING MACHINE

(75) Inventors: Timothy Rodd, Sandy Lane Lyndhurst (GB); Graham Fuller, Cranfield (GB); Peter T. M. Nott, Bath (GB); Richard Harbutt, Old Windsor (GB)

(73) Assignee: Reckitt Benckiser N.V., Hoofdorp (NL)

( * ) Notice: Subject to any disclaimer, the term of this patent is extended or adjusted under 35 U.S.C. 154(b) by 0 days.

(21) Appl. No.: 10/054,053

(22) Filed: Jan. 22, 2002

(65) Prior Publication Data

US 2002/0100773 A1 Aug. 1, 2002

Related U.S. Application Data

(63) Continuation of application No. PCT/EP00/06890, filed on Jul. 19, 2000.

(30) Foreign Application Priority Data

Jul. 23, 1999 (DE) ..... 199 34 592

(51) Int. Cl.[7] ..... G01F 11/28
(52) U.S. Cl. ..... 222/444; 222/453; 222/504
(58) Field of Search ..... 222/207, 209, 222/444, 453, 504, 449

(56) References Cited

U.S. PATENT DOCUMENTS

| | | | | |
|---|---|---|---|---|
| 3,174,647 A | * | 3/1965 | Ludwig | 222/52 |
| 3,223,285 A | * | 12/1965 | Anderson | 222/209 |
| 4,030,640 A | * | 6/1977 | Citrin et al. | 222/504 |
| 4,379,515 A | | 4/1983 | Towsend | |
| 5,033,643 A | | 7/1991 | Schumacher | |
| 5,176,297 A | | 1/1993 | Mooney et al. | |
| 6,398,081 B2 | * | 6/2002 | Bassi et al. | 222/504 |

FOREIGN PATENT DOCUMENTS

| | | | |
|---|---|---|---|
| AU | 78393/91 A | | 1/1992 |
| DE | 39 02 356 A1 | | 8/1990 |
| DE | 39 22 342 A1 | | 1/1991 |
| DE | 39 34 123 A1 | | 4/1991 |
| DE | 195 40 608 A1 | | 5/1997 |
| EP | 0 215 366 A2 | | 3/1987 |
| EP | 0 328 769 A1 | | 8/1989 |
| EP | 432319 A | * | 6/1991 |
| EP | 0 432 319 A1 | | 6/1991 |
| GB | 2330522 | * | 4/1999 |
| GB | 2 330 522 A | | 4/1999 |
| WO | 97/09480 A1 | | 3/1997 |
| WO | WO 9709480 A | * | 3/1997 |

* cited by examiner

*Primary Examiner*—Philippe Derakshani
(74) *Attorney, Agent, or Firm*—Akin, Gump, Strauss, Hauer & Feld, L.L.P.

(57) ABSTRACT

An apparatus for holding and dispensing metered doses of an active composition into a washing, drying or dishwashing machine has a supply chamber which holds at least double the amount of an individual dose of the active composition. A dispensing chamber is connected to the supply chamber by a passage in order to receive an individual dose of the active composition and to discharge the composition by way of a discharging passage. The closing of the passage between the supply chamber and the dispensing chamber, either beforehand or simultaneously, is actuated by means which are activated by conditions inside the machine, existing exclusively during a washing, drying or dishwashing cycle. The passage between the supply chamber and the dispensing chamber is re-opened and, beforehand or simultaneously, the discharging passage from the dispensing chamber is closed, so that the dispensing chamber can be re-filled from the supply chamber.

16 Claims, 4 Drawing Sheets

APPARATUS FOR HOLDING AND METERED DISPENSING OF AN ACTIVE COMPOSITION INTO A WASHING MACHINE, A LAUNDRY DRYER OR A DISHWASHING MACHINE

CROSS-REFERENCE TO RELATED APPLICATIONS

This application is a continuation of International Application No. PCT/EP00/06890, filed Jul. 19, 2000, the disclosure of which is incorporated herein by reference.

BACKGROUND OF THE INVENTION

The invention is directed to an apparatus for holding and dispensing metered amounts of at least one active composition into a washing machine, a laundry dryer or a dishwashing machine.

U.S. Pat. No. 4,379,515 discloses a dispensing device for detergent, comprising a rigid container and, communicating with this rigid container by means of a pipe, a compressible reservoir containing the measured quantity of detergent needed for one washing cycle. Under the effect of centrifugal forces generated by rotation of the laundry drum, the reservoir is compressed—particularly if it is disposed between the laundry and the wall of the laundry drum—in such a way that its contents are emptied into the rigid container, where the detergent is then dissolved by the washing liquid. A disadvantage of this dispensing system resides in the fact that the reservoir can be used for only one respective washing cycle and has to be replaced with each new washing cycle.

European patent publication EP 0 215 366 describes a detergent container with a welded seal, wherein the welded seal melts at a specific operating temperature and then releases the detergent. The seal of the container in particular cannot be used again, and in addition it is not possible to dispense more than once with this system.

European patent publication EP 0 328 769 describes a removable dispensing container with a closure that can be opened during a washing cycle and which has a manipulating extension. The pressure exerted by the laundry during the washing cycle causes the manipulating extension to be pushed into the dispensing container in such a way that the detergent is able to flow out. It is not possible to dispense more than one dose and the dispensing container must be filled again before each washing cycle.

German patent publication DE 39 02 356 discloses a dispensing container which may be used for a single washing cycle only and operates on the basis of a temperature-dependent release of a liquid fabric conditioner. The rising temperature causes the pressure in the dispensing container to rise above atmospheric pressure, as a result of which a gate valve is displaced into its open position, permitting the liquid fabric conditioner to flow into the washing machine.

U.S. Pat. No. 5,033,643 describes a dispensing container, which also allows a metering unit to be released for only one washing cycle. Forces generated by the wet laundry act on the release mechanism of the dispensing container.

German patent publications DE 39 34 123 and DE 39 22 342 describe detergent containers which are fixedly mounted on the laundry drum. Pins or locking hooks are used for fixing purposes. With these containers, no provision is made for more than one dose, which means that they have to be removed from the washing machine after every washing cycle and re-filled.

U.S. Pat. No. 5,176,297 describes a dispensing system for a dishwashing machine, which is mounted in the interior of the machine and incorporates a supply and a dispensing compartment. Although it is possible to dispense more than one dose, the dispensing system is controlled by the dishwashing machine in a complex manner.

German patent publication DE 195 40 608 discloses a system enabling more than one dose to be dispensed, in which tablets of dishwashing detergent are placed. The individual doses are controlled by a command issued by the dishwashing machine, i.e., an operating program of the dishwashing machine selected by the user controls the time at which the dose is released.

Australian published patent application AU-A-78393/91 discloses a dispensing container for a detergent, which is dispensed through an orifice opened by the build-up of internal pressure in the container. This internal pressure is generated either by the operating program of the machine or by operation directly on the part of the user.

Summing up the state of the art, dispensing systems are known which primarily permit individual doses to be dispensed and in a few cases multiple doses. In systems permitting a single dose, the release of detergent is generally operated on the basis of a delayed release, which may be triggered by means of a rise in temperature, an increase in pressure or centrifugal forces, for example. What systems permitting multiple doses have in common is that the release is mechanically triggered (valve, piston, gate, etc.) either on the basis of a command issued by the washing program of the machine or by direct operation on the part of the user.

BRIEF SUMMARY OF THE INVENTION

An underlying objective of the invention is to propose an apparatus for holding and dispensing metered doses of an active composition into a laundry washing machine, a dryer or a dishwashing machine, which enables more than one dose to be dispensed (in either one or more washing, drying or dishwashing rinse cycles) and is triggered independently of the commands of an operating program in the machine or intervention by the user.

This objective is achieved by the invention using an apparatus of the generic type having a supply chamber for containing at least double the quantity of an individual dose of the active composition. Connected to the supply chamber by a passage is a dispensing chamber for containing a single dose of the active composition and releasing the same via a discharge passage into the interior of the machine. Means are provided for opening the discharge passage and closing, beforehand or simultaneously, the passage between the supply chamber and dispensing chamber. The opening means are operated by means that are activated by conditions prevailing in the interior of the machine, which occur exclusively during a washing, drying or dishwashing cycle. Means are also provided for re-opening the passage between the supply chamber and the dispensing chamber and closing, beforehand or simultaneously, the discharge passage of the dispensing chamber in order to refill the same from the supply chamber.

In a first embodiment the apparatus proposed by the invention comprises a fluid reservoir; an expansion mechanism and a one-way valve disposed between the fluid reservoir and the expansion mechanism, so that fluid is able to flow between the fluid reservoir and the expansion mechanism. An opening/closing mechanism is operated by the expansion mechanism, in such a way that the discharge passage of the dispensing chamber is opened and the passage between the supply chamber and the dispensing chamber is closed, beforehand or simultaneously, to enable the contents of the dispensing chamber to be substantially entirely released into the machine. A return mechanism re-positions the opening/closing mechanism in the initial position; and means are provided to enable the hydraulic fluid to leave the expansion mechanism when the opening/closing mechanism is re-set by the return mechanism.

Accordingly, the flow of fluid from the fluid reservoir into the expansion mechanism is operated either by the wet laundry or dry laundry compressing the fluid reservoir directly or indirectly, in which case the opening/closing mechanism is preferably a gate valve, or by a pivotably mounted weight exerting pressure on the fluid reservoir due to the rotation of the apparatus with the washing machine or dryer drum, in which case the opening/closing mechanism is preferably a float valve. In both cases the return mechanism is preferably a return spring.

In another embodiment, the apparatus proposed by the invention comprises a one-way valve between the supply chamber and the dispensing chamber. A water chamber with a one-way valve is provided so that, at the start of an operating cycle, water disposed in the machine flows through the one-way valve into the water chamber, expanding it to the degree that the dispensing chamber is compressed. A discharge passage of the dispensing chamber is opened and, beforehand or simultaneously, the one-way valve between supply chamber and dispensing chamber is closed to permit the contents of the dispensing chamber to be substantially entirely released into the machine. Means are provided to enable the water slowly to leave the water chamber, causing the dispensing chamber to expand again. As a result, the one-way valve between the supply chamber and the dispensing chamber is opened and, beforehand or simultaneously, the discharge passage of the dispensing chamber is closed to allow the dispensing chamber to be filled from the supply chamber again. The means enabling the water to leave the water chamber preferably comprises small orifices.

In a further embodiment the apparatus proposed by the invention comprises a one-way valve between the supply chamber and the dispensing chamber. Means which alter in form, at least to a certain degree, when the temperature is increased, cause the dispensing chamber to be compressed, the discharge passage of the dispensing chamber to be opened and, beforehand or simultaneously, the one-way valve between supply chamber and dispensing chamber to be closed, to enable the contents of the dispensing chamber to be substantially entirely released into the machine. The means which alter in form undergo a reverse change of form, at least to a certain degree, on cooling, causing the one-way valve between the supply chamber and the dispensing chamber to be opened again and, beforehand or simultaneously, the discharge passage of the dispensing chamber to be closed, in order to refill the dispensing chamber from the supply chamber.

An alternative to this further embodiment of the invention is characterized by a rigid chamber with a material disposed therein, in particular a wax, which expands as the temperature increases and shrinks on cooling. Preferably, the supply chamber is designed so that it contains a wax. This being the case, it is preferable if the opening mechanism is raised by means of a flexible diaphragm, which responds to the expansion of the material.

The apparatus proposed by the invention is additionally characterized by a bimetallic strip, which bends when the temperature increases and returns to shape on cooling.

Particularly preferred, the supply chamber is designed so that it can be re-filled from the exterior.

In one particularly practical arrangement, the apparatus proposed by the invention is firmly but detachably secured in the interior of the machine.

BRIEF DESCRIPTION OF THE SEVERAL VIEWS OF THE DRAWINGS

The foregoing summary, as well as the following detailed description of the invention, will be better understood when read in conjunction with the appended drawings. For the purpose of illustrating the invention, there are shown in the drawings embodiments which are presently preferred. It should be understood, however, that the invention is not limited to the precise arrangements and instrumentalities shown. In the drawings.

DETAILED DESCRIPTION OF THE INVENTION

Figure 1:
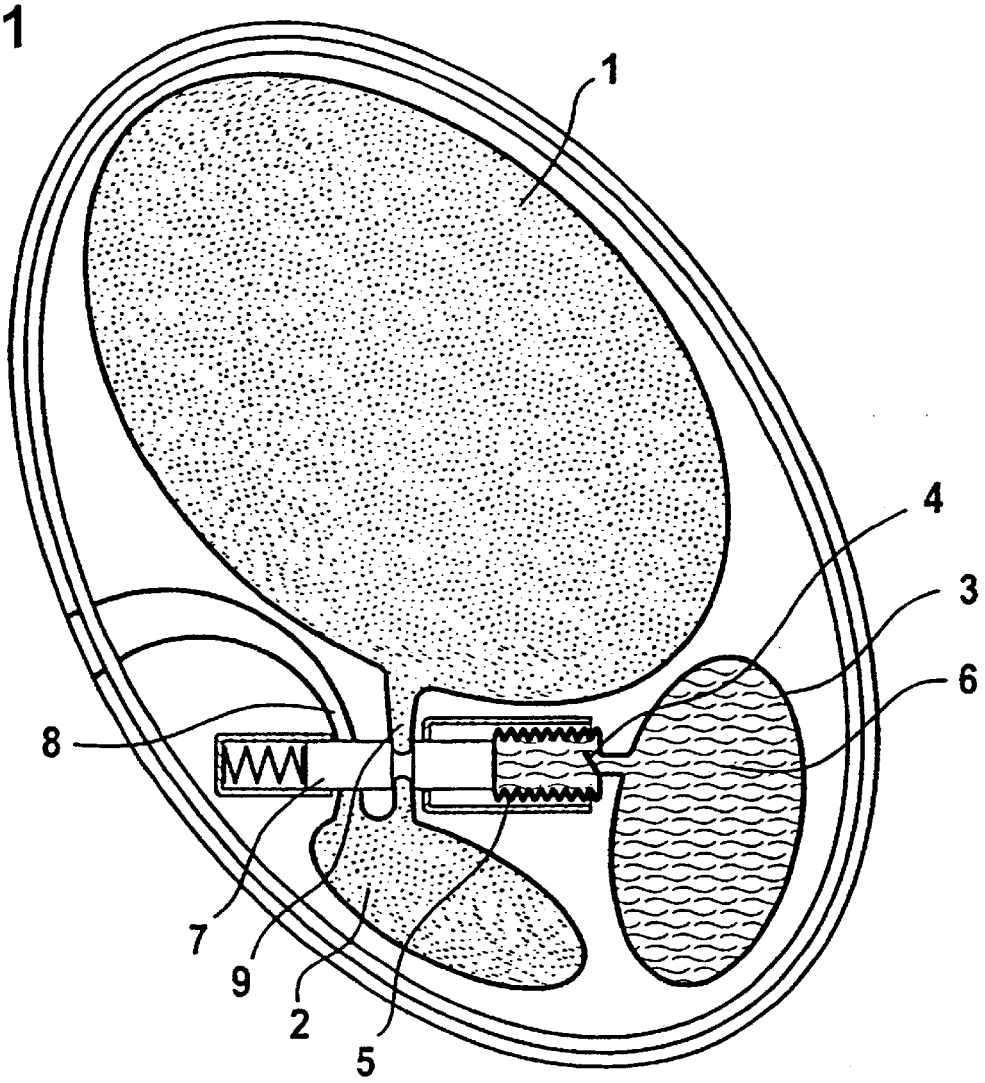
FIG. 1 is a cross sectional view through a first embodiment of the apparatus proposed by the invention in a non-dispensing state.
Figure 2:
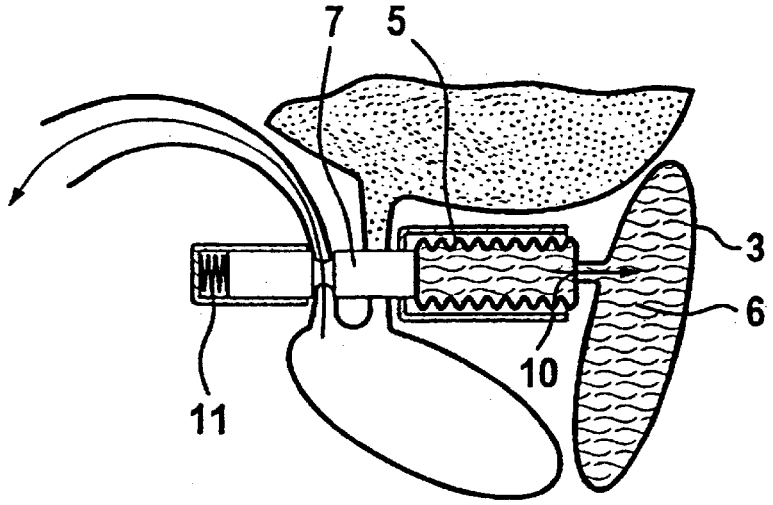
FIG. 2 is a view similar to FIG. 1 of the first embodiment of the apparatus illustrated in a dispensing state.

FIG. 1 depicts an apparatus based on a hydraulic operating mode. Accordingly, the apparatus comprises a supply chamber 1, a dispensing chamber 2 and a compressible bladder 3. The apparatus is triggered by the action of the wet or dry laundry on the compressible bladder 3, causing the latter to be compressed. A hydraulic fluid 6 (preferably water) disposed therein is discharged through a one-way valve 4 to a bellows 5. The one-way valve 4 prevents the hydraulic fluid 6 from flowing back into the compressible bladder 3. The bellows 5 displaces an opening mechanism 7 (e.g., a gate valve) so that the passage 9 between the supply chamber 1 and the dispensing chamber 2 is first closed, after which the passage 8 from the dispensing chamber 2 into the machine is opened for dispensing the active composition.

A return mechanism 11 (e.g., a spring) returns the opening mechanism 7 into its initial position, such that the discharge passage 8 from the dispensing chamber 2 to the machine is closed, and the passage 9 between the dispensing chamber 2 and the supply chamber 1 is opened again. At the same time, the bellows 5 is pushed together again, and the hydraulic fluid 6 is able to flow back, e.g., through a small orifice 10, into the compressible bladder 3, which expands to its original size. Because the passage 9 between the supply chamber 1 and the dispensing chamber 2 is open again, the dispensing chamber 2 can now be filled again.

The opening mechanism can be designed so that it is not re-positioned until a machine cycle has been completed, i.e., there will be only one dispensing action into the machine during a cycle. However, it would also be conceivable, e.g., by dimensioning the orifice 10 and the return spring 11 accordingly, for the opening mechanism to be re-set more than once during a cycle, to allow several individual doses to be released during one cycle.

It goes without saying that within the scope of the invention, other embodiments would also be conceivable. For example, it would be conceivable for the opening mechanism to open the discharge passage 8 to the machine and the passage 9 between the supply chamber 1 and the dispensing chamber 4 simultaneously. Similarly, it would also be conceivable for a measured quantity of the active composition to be completely ejected from the dispensing chamber 2 by means of a slight pressure generated by the cover of the apparatus.

Figure 3:
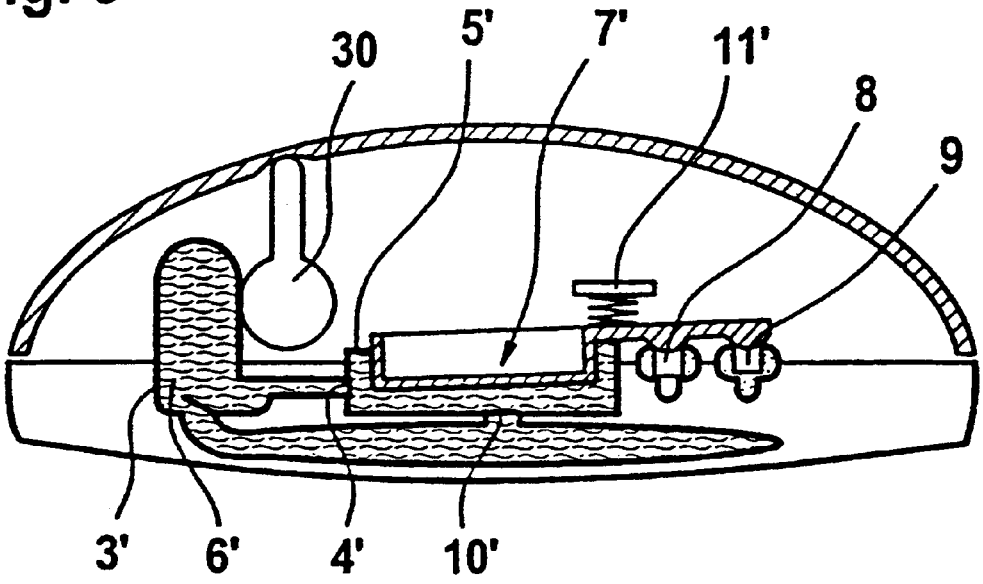
FIG. 3 is a vertical cross sectional view of a second embodiment of the apparatus proposed by the invention in a non-dispensing state.
Figure 4:
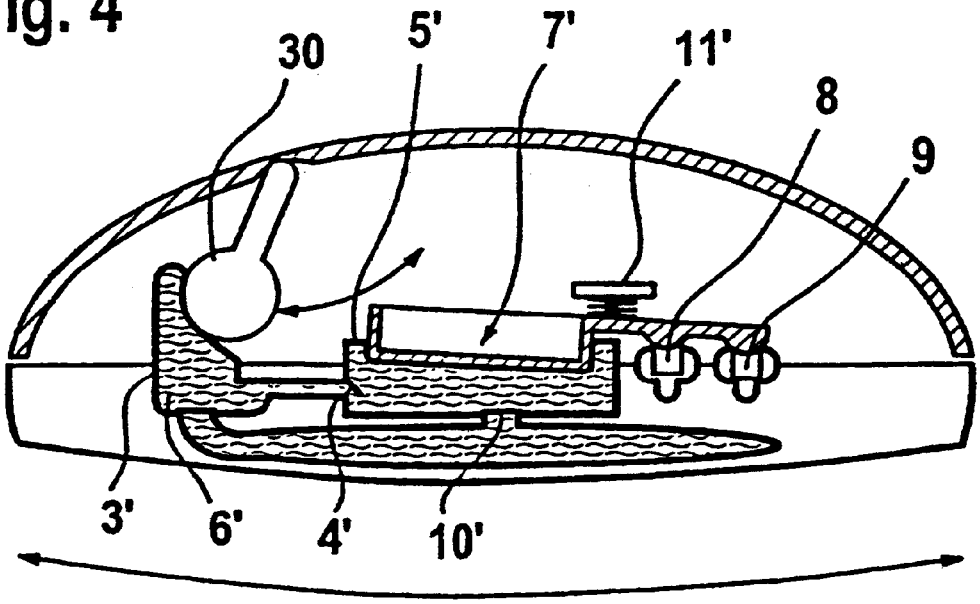
FIG. 4 is a vertical cross sectional view similar to FIG. 3 showing the apparatus of the second embodiment in a dispensing state.

A second embodiment of the apparatus proposed by the invention (FIGS. 3 and 4) is of a similar construction, but uses a different principle to operate the opening/closing mechanism. As the apparatus rotates with the washing machine or dryer drum, a pivotably attached weight 30 pushes, as it is displaced, against a compressible chamber 3'. As a result, a hydraulic fluid 6' disposed in this chamber 3' is forced through the one-way valve 4' into an expansion chamber 5'. As the expansion chamber 5' is gradually filled, the float valve 7' mounted therein rises against the pressure of the return spring 11'.

In a non-dispensing state (FIG. 3), the float valve 7' closes off the discharge passage 8 between the dispensing chamber 2 and the machine. As the float valve 7' rises, it pivots about the valve, closing off the discharge passage 8, thereby also closing off the passage 9 between the supply chamber 1 and the dispensing chamber 2. As the float valve 7' rises still farther (FIG. 4), it finally opens the discharge passage 8 so that the dispensing chamber 2 can be emptied into the machine. As the washing machine or dryer drum rotates, the float valve 7' is essentially retained in this upper position.

Once the washing machine or dryer drum stops rotating, the expansion chamber 5' slowly empties via the orifice 10', closing the discharge passage 8 to the machine again and re-opening passage 9 between supply chamber 1 and dispensing chamber 2, allowing the dispensing chamber 2 to be filled again in readiness for the next cycle.

Figure 5:
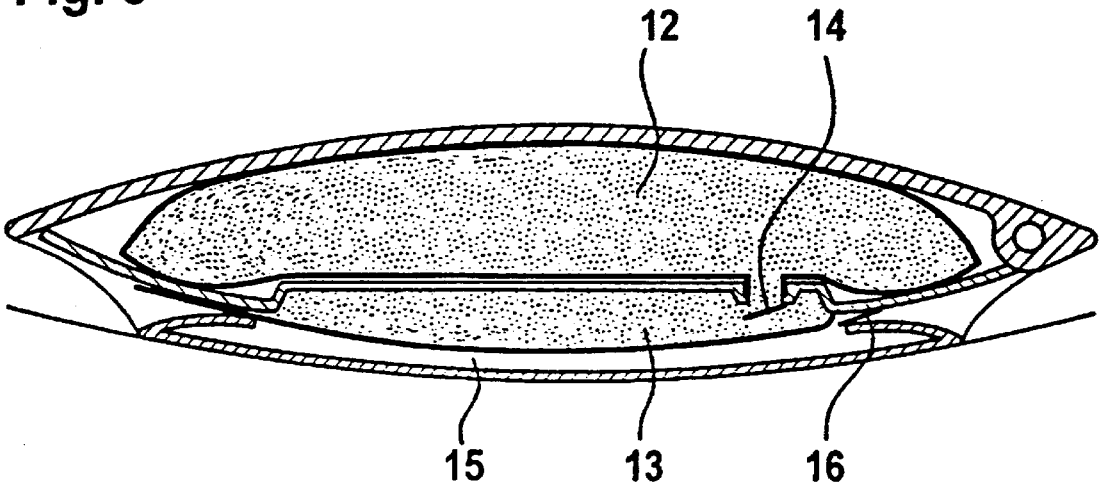
FIG. 5 is a vertical cross sectional view of a third embodiment of the apparatus proposed by the invention in a non-dispensing state.
Figure 6:
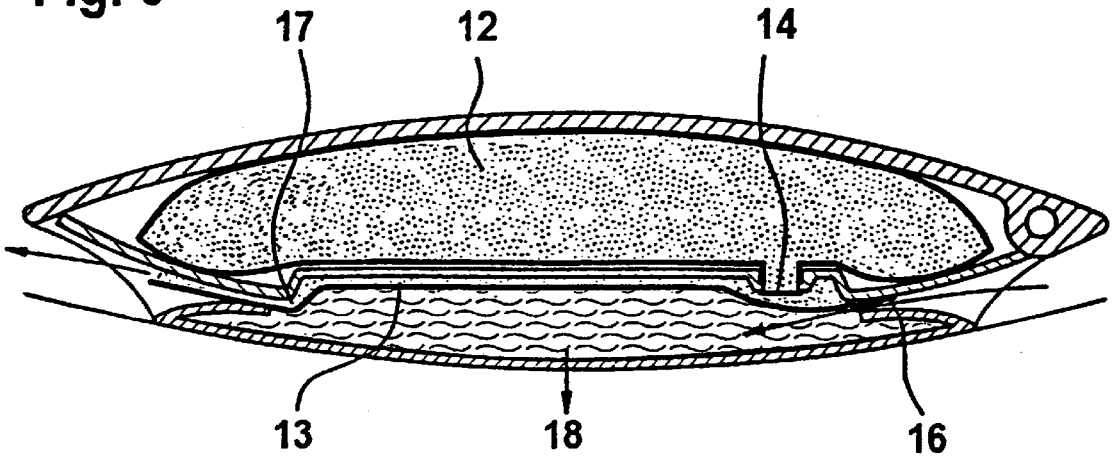
FIG. 6 is a vertical cross sectional view similar to FIG. 5 showing the apparatus of the third embodiment in a dispensing state.

The apparatus proposed by the invention illustrated in FIGS. 5 and 6 operates on the basis of a back-pressure effect and is primarily suitable for use in a laundry washing machine. The active composition is discharged from a filled supply chamber 12 via a one-way valve 14 into a dispensing chamber 13 disposed underneath the supply chamber 12. Disposed underneath the dispensing chamber 13 is a water chamber 15 into which water disposed in the machine at the start of an operating cycle flows via a one-way valve 16 and fills the chamber 15. As the water chamber 15 fills, it causes the one-way valve 14 between the supply chamber 12 and the dispensing chamber 13 to close on the one hand and, on the other hand, compresses the dispensing chamber 13 causing its contents to be released into the washing machine through a discharge passage 17. Once the operating cycle is completed, the water drains slowly out of the bottom water chamber 15 through small orifices 18, and the discharge passage 17 of the dispensing chamber 13 is closed. The dispensing chamber 13 is then able to expand, as a result of which the one-way valve 14 can re-open, enabling the dispensing chamber 13 to be filled again with active composition from the supply chamber 12.

In this third embodiment of the apparatus, it is particularly important for the bottom water chamber 15 to remain completely filled with water during the operating cycle, so that the one-way valve 14 remains closed, in order prevent any additional dispensing action from the supply chamber 12.

Another embodiment would also be conceivable in which, instead of being arranged one above the other, the three chambers were arranged in a different layout relative to one another. Instead of providing small orifices 18, it would also be conceivable to use other drainage means (e.g., a semi-permeable membrane) for draining the water from the water chamber 15.

Figure 7:
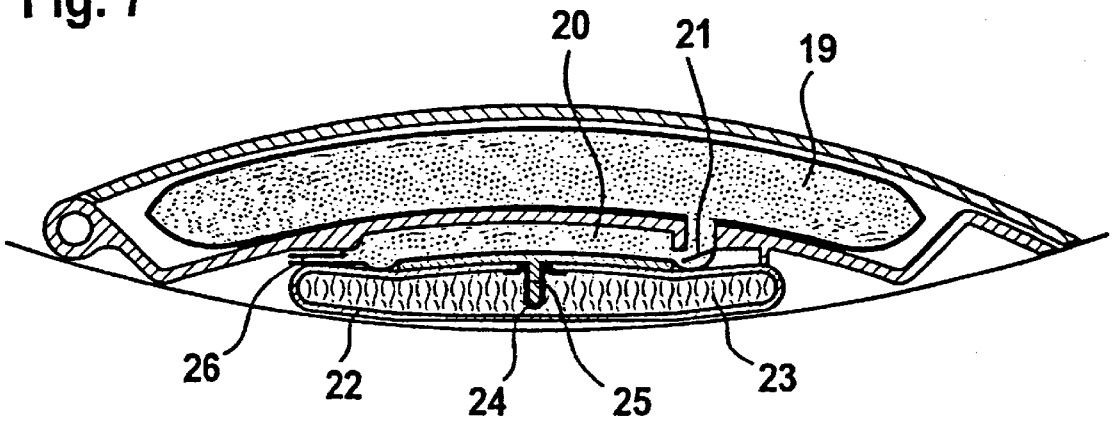
FIG. 7 is a vertical cross sectional view of a fourth embodiment of the apparatus proposed by the invention in a non-dispensing state.
Figure 8:
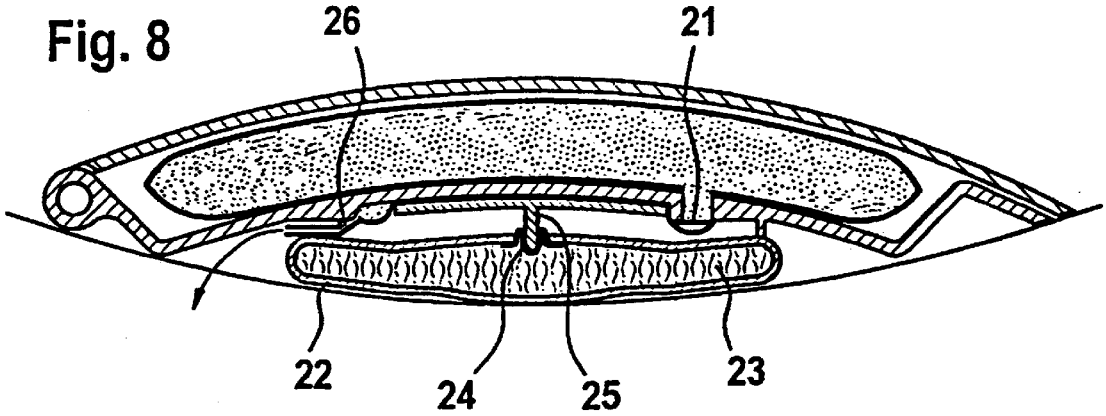
FIG. 8 is a vertical cross sectional view similar to FIG. 7 showing the apparatus of the fourth embodiment in a dispensing state.

In a fourth embodiment of the apparatus proposed by the invention, illustrated in FIGS. 7 and 8 and based on a temperature effect, a supply chamber 19 filled with active composition releases the composition via a one-way valve 21 to a dispensing chamber 20 disposed underneath the supply chamber 19. Underneath the dispensing chamber 20 is a rigid bottom chamber 22 containing a wax 23. An increase in temperature, i.e., as the water or the dryer interior is heated to the desired operating temperature, causes the wax 23 to expand, pushing a ram 25 upwards via a flexible diaphragm 24, so that it closes the one-way valve 21, compresses the dispensing chamber 20 and releases its contents through a discharge passage 26 into the washing machine or the dryer. As it then cools, the wax 23 shrinks and the ram 25 is able to return to its initial position. This causes the one-way valve 21 to open and allows the dispensing chamber 20 to be filled again with active composition from the supply chamber 19.

Also with the apparatus illustrated in FIGS. 7 and 8, the three chambers need not be exclusively disposed one above the other. The dispensing chamber 20 and the rigid chamber 22 may also be arranged adjacent to one another, for example. Similarly, one skilled in this particular art would have no difficulty in finding a suitable material other than wax. The only important thing about this material is that it should have an appropriate expansion coefficient at a selected operating temperature of the machine.

Likewise, the means 25 used to open the discharge passage 26 of the dispensing chamber 20 need not explicitly be a ram. It would also be conceivable to use a piston, for example rigid, which, because it is displaced by an expanding material, pushes the contents of the dispensing chamber, made from a very flexible material, to the discharge passage. To improve release of the active composition from the dispensing chamber, it would also be conceivable to provide more than one means for opening the discharge passage (e.g., two rams from two different positions).

In an alternative embodiment (which is not illustrated), the apparatus may also be activated on the basis of temperature by providing a bimetallic strip, which is deformed under the effect of temperature. This deformation directly or indirectly initiates the same procedure as that illustrated in FIGS. 7 and 8, where the ram 25 of the apparatus pushes via the diaphragm 24, i.e., compresses the dispensing chamber 20, opens the discharge passage 26 of the dispensing chamber 20 and, beforehand or simultaneously, closes the one-way valve 21 between supply chamber 19 and dispensing chamber 20, in order to release the contents of the dispensing chamber substantially entirely into the machine. On cooling, the bimetallic strip would likewise return to its initial shape and as a result open the one-way valve 21 again to enable the dispensing chamber 20 to be re-filled with active composition from the supply chamber 19.

In the case of a dishwashing machine, the temperature is normally increased twice during a dishwashing cycle, namely once during the cleaning cycle and a second time during the rinsing cycle. The temperature-dependent embodiments of the apparatus proposed by the invention would therefore be activated twice, i.e., an appropriate substance would be released into the dishwashing machine twice.

In all embodiments, the speed at which the fluid contained in the dispensing chamber is discharged can be controlled by appropriate means, for example by dimensioning the discharge passage 8 (FIG. 1 or 3), 17 (FIG. 6) or 26 (FIG. 8) accordingly. In this manner, a delayed release can be obtained to suit specific application requirements (for example releasing fabric conditioner in a dryer).

It is of advantage to provide means for inactivating the system, preferably of the type which do not have to be removed from the machine, so that the user can decide whether to run the machine with the system proposed by the invention in the activated state or in the non-activated state. Any type of locking mechanism that would prevent the opening mechanism 7 from being activated could be used for this purpose, preferably a system of blocking the hydraulic fluid 6.

The features of the invention disclosed in the above description, the drawings and the claims may be construed as essential to the invention in its different embodiments, both individually and in any combination.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

We claim:

1. An apparatus for holding and dispensing metered doses of an active composition into a laundry washing, drying or a dishwashing machine, comprising a supply chamber (1; 12; 19) for containing at least double a quantity of an individual dose of the active composition; a dispensing chamber (2; 13; 20) for containing a single dose of the active composition and for releasing the dose via a discharge passage (8; 17; 26) into an interior of the machine; the dispensing chamber (2, 13, 20) being connected to the supply chamber (1; 12; 19) by a passage (9; 14; 21), means (5, 7; 5', 7'; 15; 22, 23, 24, 25) for opening the discharge passage (8; 17; 26) and closing, beforehand or simultaneously, the passage (9; 14; 21) between the supply chamber (1; 12; 19) and the dispensing chamber (2; 13; 20), the means for opening and closing being operated by means (3; 3'; 16; 23) that are activated by conditions prevailing in the interior of the machine which occur exclusively during a washing, drying or dishwashing cycle, and means for re-opening the passage (9; 14; 21) between the supply chamber (1; 12; 19) and the dispensing chamber (2; 13; 20) and closing, beforehand or simultaneously, the discharge passage (8; 17; 26) of the dispensing chamber (2; 13; 20), in order to refill the dispensing chamber from the supply chamber (1; 12; 19).

2. The apparatus as claimed in claim 1, wherein the means for opening and closing comprises a fluid reservoir (3; 3'); an expansion mechanism (5; 5'), a one-way valve (4; 4') disposed between the fluid reservoir (3, 3') and the expansion mechanism (5; 5'), so that hydraulic fluid (6) is able to flow between the fluid reservoir (3; 3') and the expansion mechanism (5; 5'); and an opening/closing mechanism (7; 7') operated by the expansion mechanism (5; 5') in such a way that the discharge passage (8) of the dispensing chamber (2) is opened and the passage (9) between the supply chamber (1) and the dispensing chamber (2) is closed, beforehand or simultaneously, to enable the active composition in the dispensing chamber (2) to be substantially entirely released into the machine, and wherein the means for re-opening comprises a return mechanism (11; 11'), which re-positions the opening/closing mechanism (7; 7') to an initial position; and means (10) for enabling the hydraulic fluid (6) to leave the expansion mechanism (5; 5') when the opening/closing mechanism (7; 7') is re-positioned by the return mechanism (11; 11').

3. The apparatus as claimed in claim 2, wherein the fluid reservoir is adapted to be compressed, directly or indirectly, by wet or dry laundry to activate the flow of hydraulic fluid from the fluid reservoir (3) into the expansion mechanism (5).

4. The apparatus as claimed in claim 3, wherein the opening/closing mechanism (7) comprises a gate valve.

5. The apparatus as claimed in claim 2, further comprising a pivotably mounted weight (30) adapted to exert pressure on the fluid reservoir (3') due to rotation of the apparatus with a drum of the machine to activate the flow of hydraulic fluid from the reservoir (3') into the expansion mechanism (5').

6. The apparatus as claimed in claim 5, wherein the opening/closing mechanism (7') comprises a float valve.

7. The apparatus as claimed in claim 2, wherein the return mechanism (11; 11') has a return spring.

8. The apparatus as claimed in claim 1, wherein the means for opening and closing comprises a first one-way valve (14) between the supply chamber (12) and the dispensing chamber (13); a water chamber (15) with a second one-way valve (16), such that water disposed in the machine flows through the second one-way valve (16) into the water chamber (15) at a start of an operating cycle, expanding the water chamber (15) to a degree that the dispensing chamber (13) is compressed, the discharge passage (17) from the dispensing chamber (13) is opened and, beforehand or simultaneously, the first one-way valve (14) is closed to permit the active composition in the dispensing chamber (13) to be substantially entirely released into the machine; and wherein the means for re-opening comprises drain means (18) for enabling the water slowly to leave the water chamber (15) causing the dispensing chamber (13) to expand again, such that the first one-way valve (14) is opened and, beforehand or simultaneously, the discharge passage (17) is closed to allow the dispensing chamber (13) to be re-filled from the supply chamber (12).

9. The apparatus as claimed in claim 8, wherein the drain means (18) comprise small orifices.

10. The apparatus as claimed in claim 1, wherein the means for opening and closing comprises a one-way valve (21) between the supply chamber (19) and the dispensing chamber (20); means (22, 23, 24, 25) which alter in form, at least to a certain degree, when a temperature in the machine is increased, causing the dispensing chamber (20) to be compressed, the discharge passage (26) from the dispensing chamber (20) to be opened and, beforehand or simultaneously, the one-way valve (21) to be closed, to enable the active composition in the dispensing chamber (20) to be substantially entirely released into the machine, and wherein the means for re-opening comprises the means (22, 23, 23, 25) which alter in form, which undergo a reverse change in form, at least to a certain degree, on cooling, causing the one-way valve (21) to be re-opened and, beforehand or simultaneously, the discharge passage (26) to be closed, in order to refill the dispensing chamber (20) from the supply chamber (19).

11. The apparatus as claimed in claim 10, wherein the means which alter in form comprises a rigid chamber (22) with a material (23) disposed therein which expands as the temperature increases and shrinks on cooling.

12. The apparatus as claimed in claim 11, wherein the material (23) comprises a wax.

13. The apparatus as claimed in claim 11, wherein the rigid chamber (22) has a ram (25) for compressing the dispensing chamber (20), wherein the ram (25) is lifted by a flexible diaphragm (24) which responds to the expansion of the material (23).

14. The apparatus as claimed in claim 10, wherein the means which alter in form comprise a bimetallic strip, which bends when the temperature increases and returns to shape on cooling.

15. The apparatus as claimed in claim 1, wherein the supply chamber (1; 12; 19) is adapted to be refilled from an exterior.

16. The apparatus as claimed in claim 1, wherein the apparatus is firmly but detachably secured in an interior of the machine.

* * * * *